United States Patent [19]

Yoshida

[11] Patent Number: 4,720,727

[45] Date of Patent: Jan. 19, 1988

[54] IMAGE FORMING APPARATUS

[75] Inventor: Yasumi Yoshida, Yokohama, Japan

[73] Assignee: Canon Kabushiki Kaisha, Tokyo, Japan

[21] Appl. No.: 22,523

[22] Filed: Mar. 9, 1987

Related U.S. Application Data

[63] Continuation of Ser. No. 833,555, Feb. 27, 1986, abandoned.

[30] Foreign Application Priority Data

Mar. 4, 1985 [JP] Japan ..... 60-42272
Aug. 21, 1985 [JP] Japan ..... 60-183494

[51] Int. Cl.[4] ..... G03G 15/00

[52] U.S. Cl. ..... 355/3 R; 355/3 DR; 355/3 BE; 355/14 R; 219/216

[58] Field of Search ..... 355/3 R, 3 DR, 3 BE, 355/14 R, 14 FU, 3 FU, 30; 219/216

[56] References Cited

U.S. PATENT DOCUMENTS 4,161,357 7/1979 Herman et al. ..... 355/3 DR
4,306,802 12/1981 Kucera et al. ..... 355/3 R
4,319,828 3/1982 Komori et al. ..... 355/3 R
4,545,671 10/1985 Anderson ..... 355/3 FU X
4,571,056 2/1986 Tani et al. ..... 355/3 FU
4,585,319 4/1986 Okamoto et al. ..... 355/3 FU X

FOREIGN PATENT DOCUMENTS 157328 8/1983 Japan .

*Primary Examiner*—A. C. Prescott
*Attorney, Agent, or Firm*—Fitzpatrick, Cella, Harper & Scinto

[57] ABSTRACT

An image forming apparatus includes a drum heater for heating an image bearing member and a guide for guiding air to the image bearing member. The guide forms a path of the air flow. In the path, there are provided a filter for removing dust from the air adjacent an optical system, a fan and a heater for heating the air. The air heated by the heater is introduced to the image bearing member after passing by or around a corona wire of a charger of the image forming apparatus so as to remove moisture from the image bearing member.

31 Claims, 12 Drawing Figures

IMAGE FORMING APPARATUS

This application is a continuation of application Ser. No. 833,555 filed 2/27/86 , (now aband).

FIELD OF THE INVENTION AND RELATED ART

The present invention relates to an image forming apparatus, such as an electrophotographic copying apparatus and a laser beam printer wherein an image bearing member thereof is heated for stabilized image formation. In the image forming apparatus such as electrophotographic copying machine or the like, the image bearing member thereof such as a photosensitive member exhibits a dependency on the temperature thereof with the result that the image quality changes depending on the ambient temperature. Also, when the surface of the image bearing member is moist, the image formed on the image bearing member is not stable, and a clear image can not be obtained.

In order to solve these problems, it is known that a drum heater is provided within the image bearing member to heat the image bearing member to a proper temperature and maintain it, which is also effective to remove the moisture on the surface of the image bearing member.

However, when the power source for the image bearing member is rendered "off", the drum heater is also deenergized, and the ambient moisture condenses on the drum surface. If this occurs, the subsequent image formation is not stable. Particularly when the image bearing member surface is uniformly charged by an ion generating means such as a corona charger, the uniform charging operation is not assured, resulting in non-uniformly charged surface of the image bearing member to such an extent that portions of the image may become absent. In order to remove the candensation deposited on the surface of the image bearing member, a long period of time is required by the heater. Further, even if the temperature of the image bearing member is controlled by a drum heater, there is a case where it is not satisfactory under a highly humid conditions. In this case, an increase of the temperature of the image bearing member can give rise to non-uniform images.

SUMMARY OF THE INVENTION

Accordingly, it is a principal object of the present invention to provide an image forming apparatus by which clear images can be provided under stabilized operation.

It is another object of the present invention to provide an image forming apparatus wherein the moisture can be satisfactorily removed.

It is a further object of the present invention to provide an image forming apparatus wherein an ion generating portion of an ion generating means such as a corona wire is prevented from contamination.

It is a further object of the present invention to provide an image forming apparatus wherein noxious products of an electric charging action, such as ozone are effectively removed, and wherein the moisture can be removed from the image bearing member.

It is a further object of the present invention to provide an image forming apparatus wherein a good image forming operation can be effected by accomplishing those objects.

It is a further object of the present invention wherein the time required for the image bearing member to be sufficiently deprived of the moisture is reduced, so that a good image forming operation becomes possible quickly.

It is a further object of the present invention to provide an image forming apparatus wherein the image bearing member is always satisfactorily dried without influence to the image bearing member property depending on the temperature.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
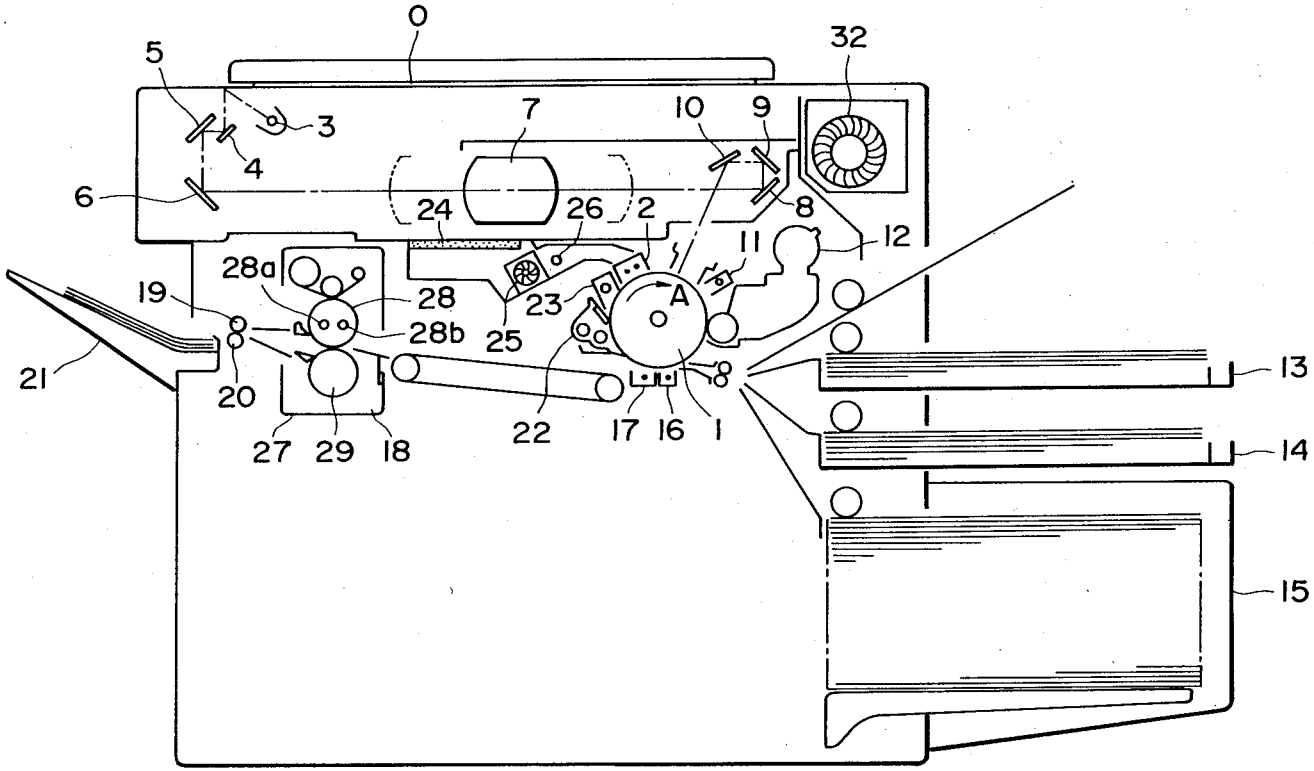
FIG. 1 is a sectional view of an image forming apparatus according to an embodiment of the present invention.

Referring to FIG. 1, there is shown an electrostatic photographic copying apparatus as an example of an image forming apparatus according to an embodiment of the present invention.

The electrophotographic copying apparatus comprises an image bearing member in the form of a photosensitive member 1 which is rotatable in a direction indicated by an arrow A. With its rotation, the photosensitive member 1 is uniformly charged by an ion generating means in the form of a corona charger 2 in this embodiment at the start of an image forming process. In this embodiment, the photosensitive member 1 has a photosensitive layer of amorphous silicon. Then, the photosensitive member 1 is exposed to image light which is provided by the light produced by an illumination light source 3 illuminate to an original O to be copied and then reflected thereby. The image light is projected and is imaged on the surface of the photosensitive member 1 by way of mirrors 4, 5 and 6, a lens 7 and mirrors 8, 9 and 10, so that an electrostatic latent image is formed thereon in accordance with the image light. Then, a blank exposure lamp 11 is turned on, and it illuminates the following surface of the photosensitive member 1 in its entirety so as to eliminate the electric charge which has been applied by the primary charger.

The thus formed electrostatic latent image is visualized by a developing device 12 into a toner image, which is then transferred by a corona charger 16 onto a transfer material which is fed from the feeding cassette 13, 14 or 15. After receiving the toner image, the transfer material is separated from the photosensitive member 1 by a separation charger 17. The transfer material is conveyed to an image fixing device 18, where the toner image is fixed on the transfer material. The transfer material having the fixed image is discharged onto a discharge tray 21 by discharging rollers 19 and 20. On the other hand, the toner remaining on the photosensitive drum 1 is removed by a cleaning device 22 and is collected into an toner container (not shown) disposed at a front position. The electric charge remained on the photosensitive member 1 is removed by an illumination device 23 illuminating the surface of the photosensitive member 1. Then, the photosensitive drum 1 is again charged by the charger 2, and the above described operations are repeated.

Figure 2:
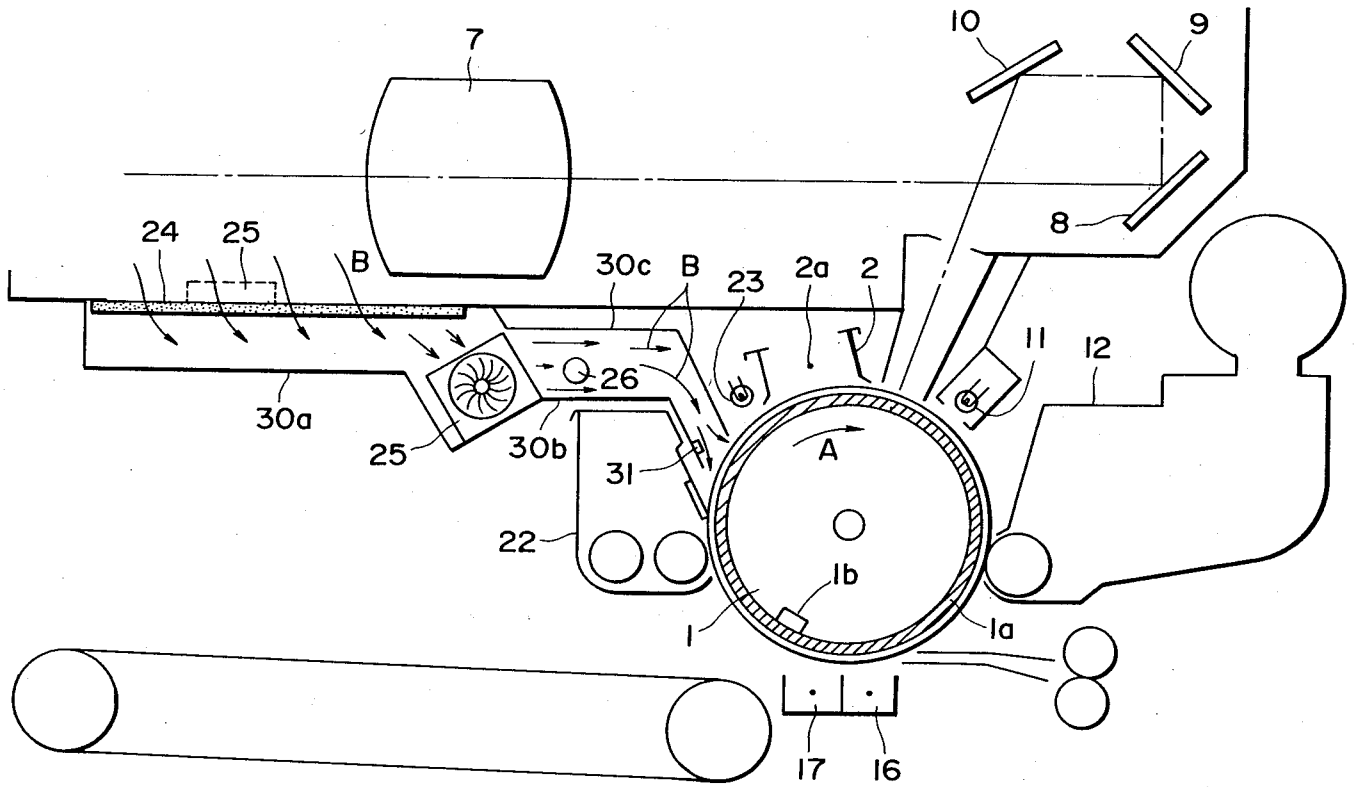
FIG. 2 is an enlarged sectional view of the image forming apparatus according to the embodiment of the present invention.

FIG. 2 is an enlarged sectional view of a part of the apparatus according to this embodiment, wherein a drum heater la is shown. The drum heater 1*a* is effective to heat the amorphous silicon photosensitive member 1 up to 30°-60° C., preferably, 40°-45° C. The amorphous silicon photosensitive member exhibits a relatively high temperature depending property. And, a preferred temperature therefor is higher than an ordinary room temperature, so that the drum heater is particularly effective. Additionally, a stable property can be used without being influenced by the change in the ambient temperature, when the drum heater is used. The drum heater is also effective when a selenium or OPC photosensitive member or the like is used, although it is particularly effective when the amorphous silicon photosensitive member is used. In this Figure and the following Figures, the same reference numerals are assigned to the means and elements having the same functions.

The apparatus comprises a fan 25 to produce flow of air. The suction opening of a suction side duct (or guide) 30*a* is provided with a filter 24 so as to remove dust from the air introduced to the fan, so that the air from the fan 25 does not adversely affect the image forming operation. The air from the fan 25 is guided by ducts 30*b* and 30*c* along the inside surfaces thereof, and it flows to the surface of the photosensitive member 1. The ducts or guides 30*a*, 30*b* and 30*c* constitute an entire duct or guide 30. The outlet opening of the duct 30*c* is disposed between the cleaning device 22 and the charger 2. The flow of the air is indicated by an arrows B. The filter 24 is disposed between the space occupied by optical means and the fan 25 with respect to flow of the air. An air heater 26 is located downstream of the fan and upstream of the photosensitive member 1 with respect to the flow of the air. As described, the air introduced to the surface of the photosensitive member 1 has been substantially dust free because of the provision of the filter 24, and therefore, the air does not damage the photosensitive member 1, or disturb an image formation. Since the air heater 26 is located at such a position, the decrease of the temperature in the duct is not large.

It is possible that the fan 25 may be located upstream of the filter 24, as shown by broken lines indicated by the reference 25. This arrangement requires less total space so that it is effective when the space around the photosensitive member 1 is not abundant.

In order to not restrict the air delivering power of the fan 25 by the filter 24, it is preferable that the filter 24 is an electrostatic type filter which can electrostatically remove the dust and foreign matter.

The air is heated by the air heater 26 to 30°-60° C. and is discharged to the surface of the photosensitive member 1 in a position upstream of the corona charger 2 with respect to movement of the periphery of the photosensitive member 1 to remove moisture from the surface thereof. The moisture removing effect is very high since the flow of warm air is used. The photosensitive member 1 is thus substantially dried before being subjected to the corona charger 2. The corona charger 2 can electrically charge the dried photosensitive member 1, thus avoiding non-uniform charging and providing stabilized image formation.

Figure 5:
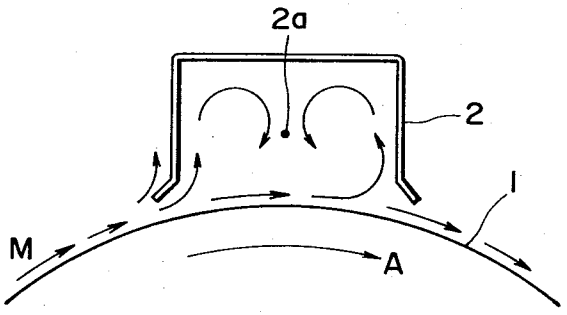
FIG. 5 is a sectional view of an image forming apparatus around a charger to illustrate the action of air flow.

FIG. 5 illustrates the air flow around the corona charger 2. The corona charger which produces ions to be applied to the photosensitive member is not able to charge the photosensitive member uniformly when the ion generating portion is contaminated. As shown in FIG. 5, the air flow M which naturally occurs in the neighborhood of the surface of the photosensitive member 1 when it rotates in the direction of the arrow A, which air flow will be hereinafter called "drum wind", reaches a corona wire 2*a* of the corona charger 2, which is the ion generating portion thereof. Since the drum wind M contains scattered particles of the developer or fine foreign matter, it contaminates the corona wire 2*a*, which can cause disturbance of the image.

Since, the products in the form of gases as a result of the charging operation, such as ozone, ammonium nitrate and other ions, are hydrophilic, they absorb the moisture and cover the surface of the photosensitive member 1. If this occurs, the electric charge applied by the corona charger is not stable, and as a result, a portion of the image may not be formed or that the image, which should be uniform is not. This problem is not solved in the arrangements shown in FIG. 2, because the air is directed to the surface of the photosensitive member 1 in the direction opposite to the drum wind M.

Figure 3:
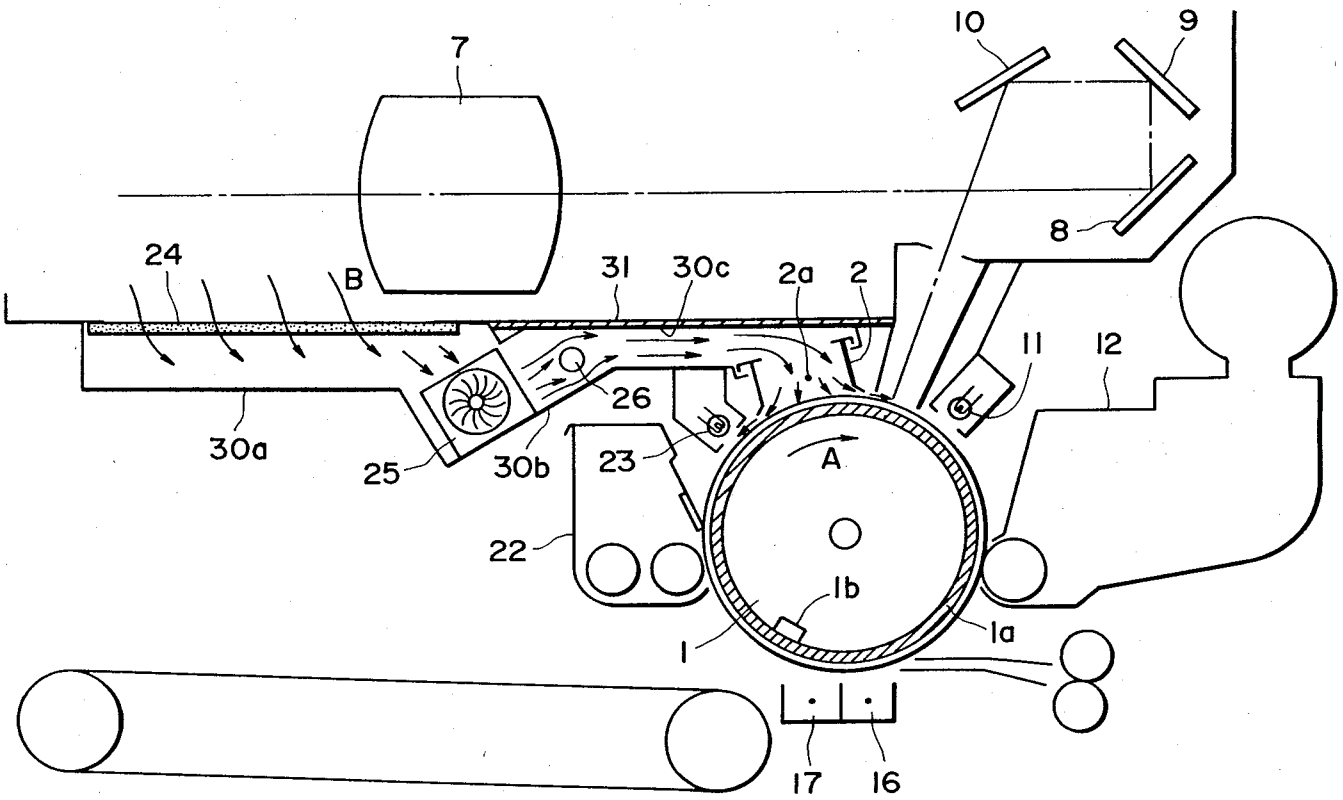
FIG. 3 is an enlarged sectional view of a part of an image forming apparatus according to another embodiment of the present invention.

FIG. 3 is a sectional view of a part of an apparatus according to another embodiment of the present invention, whereby this problem is solved without increasing the size of the apparatus and without the necessity of the space for the opening. In this embodiment, the corona charger 2 is provided with a shield having a longitudinal openings in the entirety of the corona charging portion. The air flow B is blown through the opening to the photosensitive member 1. More particularly, the air is deprived of the dust or foreign matter by the filter 24 as in the embodiment of FIG. 2 and guided by the guide 30. The air is heated by the heater 24 up to a proper temperature and is directed into the corona charger 2 at a speed of 0.5-3 m/sec. The air passes around the corona wire 2*a*, and then is discharged to the surface of the photosensitive member 1, along which the air then flows out. The fan 25 disposed immediately before the heater 26 is substantially effective to produce this flow of air B. To do this, the position of the fan 25 also be immediately after the heater 26 or immediately before the filter 24.

Thus, without decreasing the moisture removing effect of FIG. 2, this embodiment is able to more effectively prevent contamination of the ion generating portion, and is able to blow out the noxious products of the charging action produced during ion generation (ozone, NOx and the like). Thus, a better image formation is possible.

The air conveyed to the photosensitive member 1 is taken from the side where the optical means are arranged. This is preferable because the illumination optical source is disposed in that side, and it necessarily heats the surrounding air several degrees (° C.) higher than the room temperature. The utilization of this heated air assists the heater 26. On the other hand, it is preferable that the ambient temperature around the optical system is preferably not increased, and therefore, it is cooled by a fan 32. Therefore, it is preferable that heat insulating material 31 is disposed between the duct 30*c* and the space for optical system. The insulating material 31 is effective to prevent the possibility that the ambient air around the optical system is heated by the heater 26. Simultaneously, the decrease of the temperature of the air flow B can be prevented, which may be caused by the ambient air around the optical system, which is cooled by the fan 25. The air conveyed from the heater 26 to the photosensitive member 1 is maintained at the desired temperature and is not cooled significantly before reaching the photosensitive member 1, thus, the provisions of the duct or guide 30 and the heat insulating material 31 are preferable.

In FIGS. 2 and 3, the heater 26 is provided particularly for this purpose, but a heater for an image fixing device may be used also for this purpose. Usually to heat-fix the image, the image fixing device is provided with a heater. Therefore, it is possible that the guide 30 is extended from the fixing device to the image bearing member so as to utilize the air existing around the image fixing device and heated thereby. In this case, the necessity of using the heater 26 may be eliminated.

Figure 4:
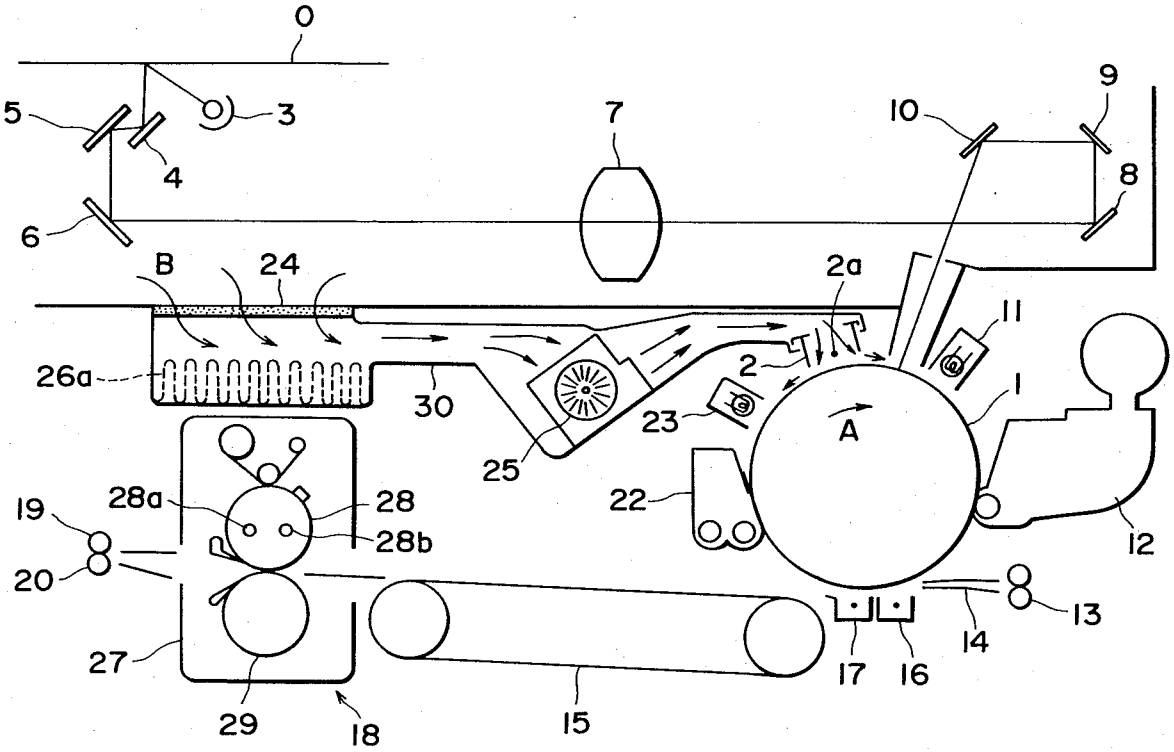
FIG. 4 is a sectional view of an image forming apparatus according to a further embodiment of the present invention.

FIG. 4 illustrates an image forming apparatus according to a further embodiment of the present invention, wherein the heat provided by the image fixing device is utilized. In this embodiment, a part of the duct 30 is disposed right above or adjacent to the fixing device 18 so that the part of the duct 30 is sufficiently heated by heat radiation and conduction from the fixing device 18. Then, the air flowing in the duct 30 is heated by heat conduction to warm air, which is introduced into the corona charger 2. It is preferable to provide or form heat exchanger fins 26*a* on the surface of the duct wall facing to the heat fixing device, since this arrangement increases the amount of heat transfer is increased. In this embodiment, the particular heater for the air flow is not used, but it is possible to use a heater such as the heater 26 in the foregoing embodiment, and the heat from the fixing device is utilized as an asisting heat.

In an image forming apparatus comprising a lamp heater for heating the illumination source 3, it is possible to utilize the heat provided by the lamp heater. In this case, a duct or guide is extended to the neighborhood of the lamp heater without interference with the optical path of the optical system. By doing so, it is possible to utilize the air heated by the lamp heater.

In the embodiments shown in FIGS. 2 and 3, the air in the optical system side is fed to the image bearing member, that is, the photosensitive member 1 in this embodiment, the optical system serving to form an image of the original thereon. This is preferable because the temperature of that air is more or less higher than the outside ambient air due to the light producing energy.

An example of control for the heating means in FIGS. 2 and 3 embodiments will be described.

Condensation tends to occur when the photosensitive member is moist or when the image forming apparatus has been kept rest for a relatively long period of time. This tendency is increased when the drum heater has been deenergized during the rest period. Therefore, it is preferable to use control means for the heater, by which the heater is energized during the initial stage of operation, which is the stage from the start of supplying electric power to the apparatus to the image bearing member being sufficiently dried (moisture removal).

Figure 6:
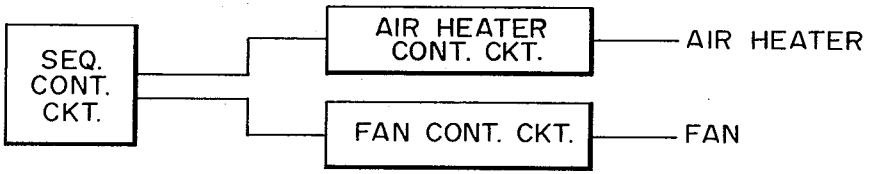
FIG. 6 is a block diagram of a control according to an embodiment of the present invention.
Figure 7:
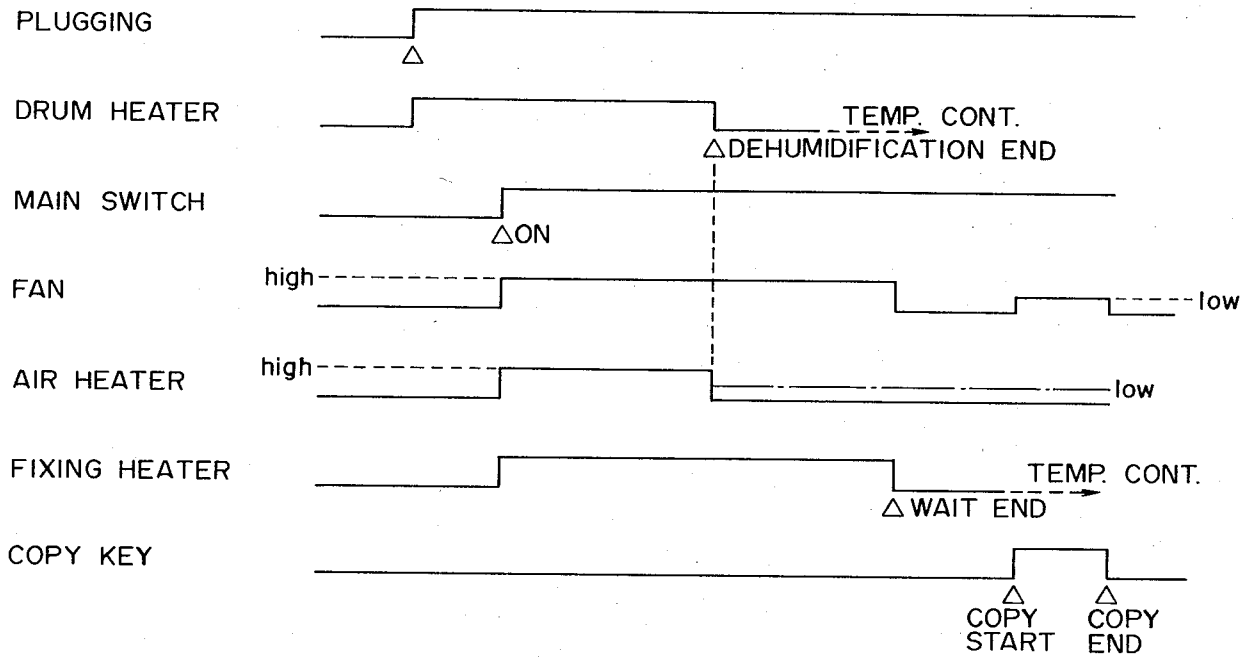
FIG. 7 is a timing chart according to an embodiment of the present invention.

FIGS. 6 and 7 illustrate the sequential control and the timing chart, from which it will be understood that the heater is energized during the initial stage. After the completion of the moisture removing operation, the drum heater may be deenergized, however, it may be kept energized when a further moisture removing operation is desired. Many of the image forming machines of the type shown in FIG. 1 are such that the machine is kept in a waiting condition until the image formation is enabled. It is possible that the drum heater is operated during this waiting time to remove the moisture from the image bearing member by the warm air provided in the manner described above. After the moisture has been removed from the image bearing member, that is, during the stabilized operation of the apparatus, the heater may be deenergized, or it may be supplied with lower energy as shown in FIG. 7. During the initial stage, the heater is supplied with the relatively higher energy so as to discharge to the image bearing member the higher temperature air than the stabilized operation period. In this case, the time required for the moisture removal can be reduced to make it possible to obtain the desirable images without delay. In this case, it is possible to employ plural heaters, wherein a greater number of heaters are energized during the intial stage.

Figure 8:
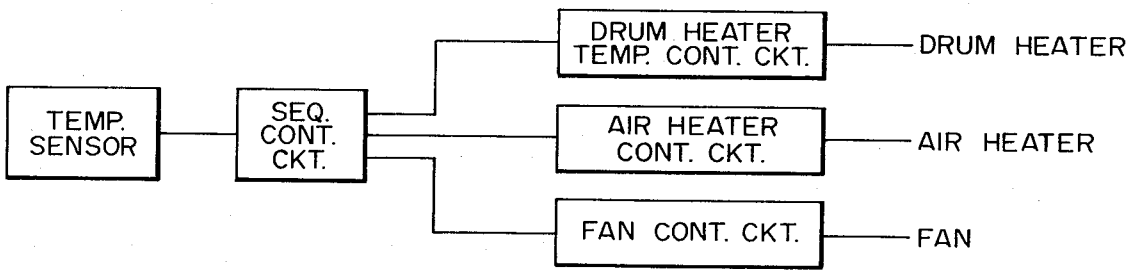
FIG. 8 is a block diagram according to an embodiment of the present invenion.

As an alternative, when the fan 25 is used, the speed of the air flow may be changed between the initial stage and the stabilized period. More particularly, the speed is higher in the initial stage to enhance the moisture removing power. To do this, the rotational speed of the fan 25 is made higher during the initial stage. As an alternative, plural fans may be used which are selectively actuated to obtain the similar effects, or a control damper may be employed at the suction side or delivery side thereof. When the speed or rate of the air flow is increased, the temperature rise of the air is decreased, so that it is preferable to increase the heating power, too. As an alternative of the method of control, the time period sufficient to remove the moisture from the image bearing member is predetermined, and the heater is energized during the predetermined period in the initial stage. FIG. 8 relates to a further embodiment according to the present invention, and shows a block diagram for the control of the heater. In this embodiment, there is provided a temperature sensor 1*b* (FIGS. 2 and 3) for detecting the temperature of the image bearing member. In accordance with the output of the temperature sensor, both of the drum heater and the air heater is controlled.

By controlling the drum heater and the air heater in accordance with the output of the temperature sensor, it is possible to keep a substantially constant temperature of the photosensitive member, whereby further stabilized image formation is possible. In this embodiment it is also preferable that the air heater is energized during the initial stage.

Figure 9:
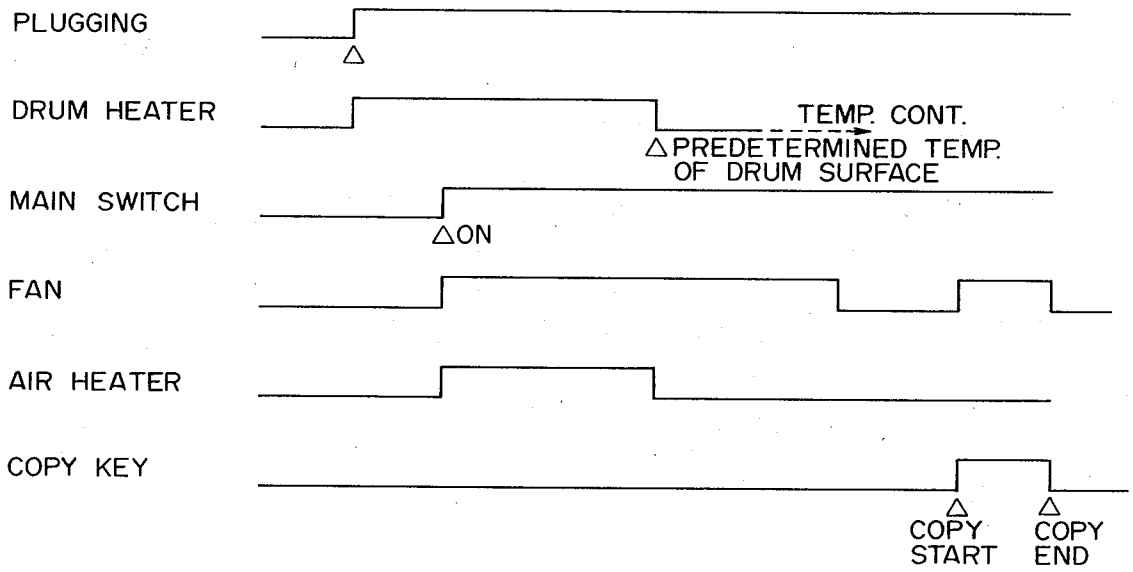
FIG. 9 is a timing chart according to an embodiment of the present invention.

FIG. 9 is a timing chart of an example of the control. Upon plugging in the apparatus, the drum heater 1*a* is directly energized to increase the surface temperature of the photosensitive member 1. When a main switch is actuated thereafter, the fan 25 and the air heater 26 are energized so that a warm air is applied to the surface of the photosensitive member 1 through the corona charger 2, thus removing moisture from the surface. Inside the photosensitive member 1, there is provided a temperature detecting thermister 1*b*. When the temperature of the surface of the photosensitive member 1 reaches a temperature with which the moisture can be removed by the drum heater 1*a* (40°–45° C., for example), and is controlled at that temperature, the air heater 26 is deenergized. This temperature is preferably 30°–60° C. for an amorphous silicon photosensitive member, and particularly preferably 40°–45° C.

As mentioned before the propert of the image bearing member is dependent upon the temperature thereof, and therefore, it is preferable to keep it in a preferable range of temperature by the drum heater. The temperature can change depending on the temperature of the air applied thereto. For this reason, it is preferable that the warm air discharged to the image bearing member is generally equal to the temperature of the image bearing surface at which the drum heater is to keep. By this, the temperature dependence properties of the photosensitive member can be kept within a preferable state so that desired image quality can be assured.

Figure 10:
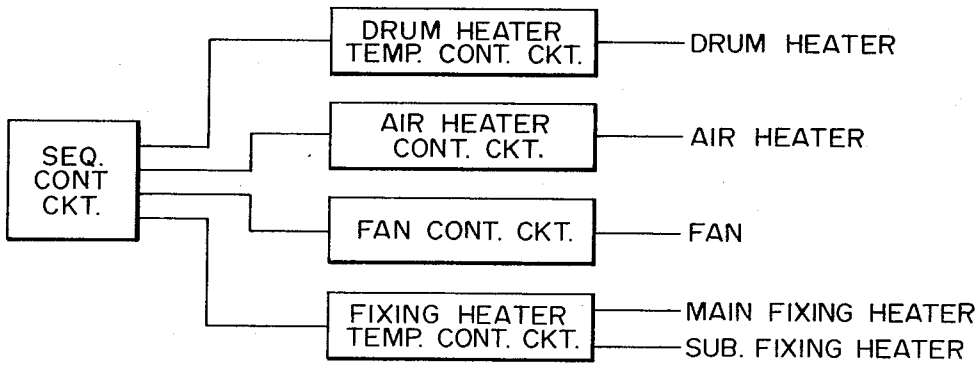
FIG. 10 is a block diagram of a control used with a modified embodiment of the present invention.
Figure 11:
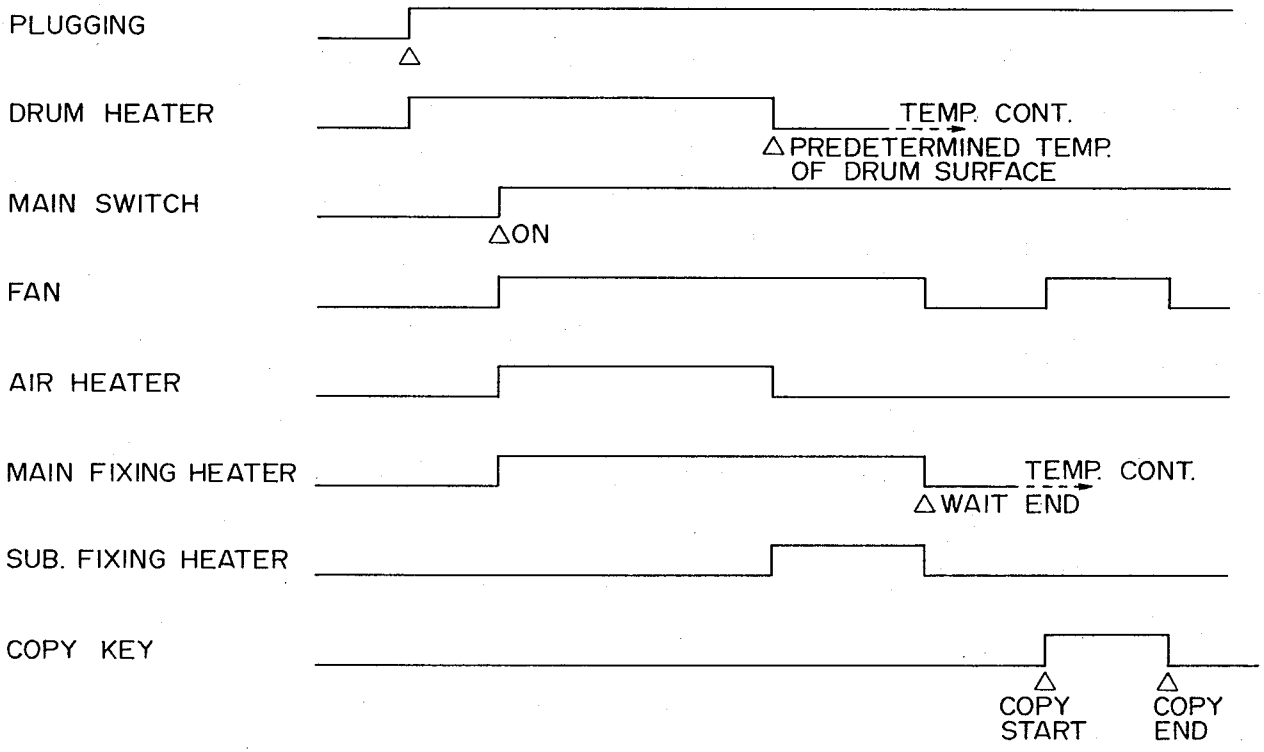
FIG. 11 is a timing chart of operation in an apparatus according to an embodiment of the present invention.

FIGS. 10 and 11 are a block diagram and a timing chart illustrating another example of control, wherein the power for the heater for the image fixing device is utilized. As shown in FIG. 1, the fixing device 18 comprises within a frame 27 a fixing (heating) roller 28 and a pressing roller 29, and the fixing roller 28 is provided therewithin two heaters 28*a* and 28*b*, which are independently actuated and deactivated.

Figure 12:
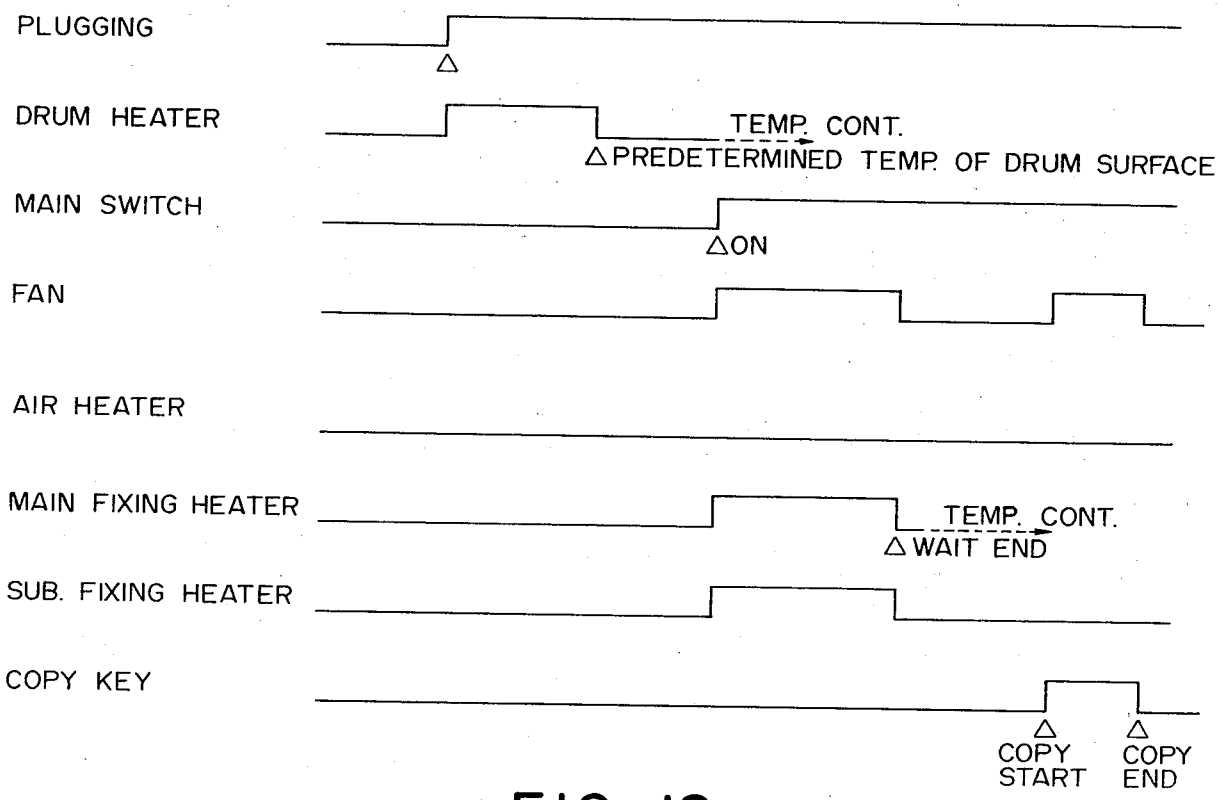
FIG. 12 is a timing chart of operation of an apparatus according to an embodiment of the present invention.

When the main switch is turned on after a long period of inactivity, the main heater 28*a* is energized to heat the fixing roller 28, and simultaneously, the fan 25 and the air heater 26 are energized to discharge warm air to the surface of the photosensitive member 1 through the charger 2, and in addition, the drum heater 1*a* is energized, whereby the surface temperature of the photosensitive member 1 increases. However, the subheater 28*b* is kept "off". The power to be distributed to the sub-heater 28*b* is used during this period for the air heater 26. When the surface temperature of the photosensitive member 1 reaches the moisture removable temperature, which is detected by the thermister 1*b*, the air heater 26 is deenergized, instead, the subheater 28*b* is energized to assist the heating of the fixing roller 28. By this, the waiting time determined by the entire electrophotographic system is reduced. When the apparatus is kept being plugged in, the drum heater 1*a* has already been energized as shown in FIG. 12, so that the surface of the photosensitive member 1 has been dried, and therefore, it is not necessary to apply the air flow to the surface. In this case, therefore, the two heaters 28*a* and 28*b* are simultaneously energized upon the actuation of the main switch Thus, the waiting time is further reduced.

The data obtained with this embodiment will be described. The capacities of the elements were as follows:

Drum heater 1*a*: 160 W,

Air heater 26: 400 W,

Main heater 28*a* of the fixing roller: 800 W, and

Sub-heater 28*b* of the fixing roller: 400 W.

The data for the air when the fan 25 and the air heater 26 are energized, were, adjacent the surface of the photosensitive member, as follows:

Temperature: approx. 52° C.,

Speed of the air flow: 1.5 m/sec, and

Rate of the air flow: 0.54 $m^3$/min.

(1) The initial stage under the condition that the apparatus being kept plugged in:

Since the drum heater 1*a* has been kept "on", there is no possibility of image deterioration, such as flow of the image. Upon actuation of the main switch, the main heater 28*a* and the sub-heater 28*b* are energized whereby the fixing roller 28 is heated. It required approximately 3 min. for the fixing device 18 to reach the temperature at which the toner image can be sufficiently fixed on the transfer material (approx. 180° C.). This was the waiting time from the actuation of the main switch.

(2) The apparatus has been kept unplugged, and the warm air is not applied after actuation of the main switch:

When the apparatus is plugged in, and the main switch is actuated, the drum heater 1*a*, the main heater 28*a* and the sub-heater 28*b* are energized. It required approximately 3 min. for the fixing device 18 to reach the fixable temperature. However, it required approximately 12 min. for the surface temperature of the photosensitive member 1 to reach the temperature at which the flow or washing of the image was sufficiently prevented. In this case, only the drum heater 1*a* was used for heating the drum. This period was the waiting time of the entire system of the apparatus.

(3) The warm air impinges on the drum surface, and the main heater 28*a* is used:

When the apparatus is plugged in, and the main switch was actuated, the drum heater 1*a*, the fan 25, the air heater 26 and the main heater 28*a* are energized. The moisture was removed from the surface of the photosensitive member 1 by both of the drum heater 1*a* and the warm air. It required approximately 3 min. for the surface temperature of the drum 1 to reach the temperature at which the flow of the image was sufficiently prevented.

When the surface temperature of the photosensitive member was controlled at the proper level, the air heater 26 was deenergized, and the sub-heater 28*b* was energized. The image fixing device 18 had been heated only by the main heater 28*a*, but after the surface temperature of the photosensitive member was controlled at the proper level, the sub-heater 28*b* was energized. The waiting time required by the fixing device was approximately 4 min. Therefore, the waiting time of the entire system of the apparatus was approximately 4 min. This means that the waiting time was reduced by one fourth of the conventional apparatus.

In the foregoing description, an apparatus is taken wherein the drum heater is actuated when the apparatus is plugged in. It is possible to use the present invention in an apparatus of the type wherein the drum heater is actuated after the main switch is actuated. This apparatus requires a longer period of time for the drum heater to reach the moisture removable temperature, and therefore, the present invention is further effective.

It is possible to combine any of the above described embodiments without losing the respective advantages.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:
an image bearing member;
first heating means for heating said image bearing member;
second heating means for heating air;
means for guiding the air heated to said image bearing member; and
means for controlling said second heating means to operate it during an initial stage of operation of said image forming apparatus.

2. An apparatus according to claim 1, wherein said guiding means includes a fan.

3. An apparatus according to claim 2, further comprising a filter for removing dust from the air, which is disposed downstream of the fan with respect to a direction of flow of the air.

4. An apparatus according to claim 2, further comprising second heating means disposed downstream of the fan with respect to a direction of flow of the air.

5. An apparatus according to claim 1, wherein said image bearing member is maintained by said first heating means during image forming operation of said image forming apparatus at a temperature higher than a normal temperature.

6. An apparatus according to claim 5, wherein said image bearing member has a surface layer of amorphous silicon, and said second heating means is effective to heat the air to a level by which the air has a temperature of 30°-60° C. when reaching said image bearing member.

7. An apparatus according to claim 1, further comprising means for generating ions to be applied to said image bearing member, said ion generating means having an ion generating portion in a path of flow of the air to said image bearing member.

8. An apparatus according to claim 7, wherein the ion generating portion is disposed upstream of said image bearing member with respect to a direction of flow of the air, whereby the air reaches said image bearing member after the ion generating portion.

9. An apparatus according to claim 1, wherein said control means energizes said second heating means during a waiting period.

10. An apparatus according to claim 1, wherein said control means controls said second heating means so as to heat the air during an initial stage of operation of said image forming apparatus to a temperature higher than that during a stabilized period of operation thereof.

11. An apparatus according to claim 10, wherein said control means controls said second heating means to supply during the initial stage higher electric energy to said second heating means than during the stabilized period.

12. An apparatus according to claim 11, wherein said second heating means includes a plurality of heaters, and wherein number of the heaters energized is larger during the initial stage than that in the stabilized period.

13. An apparatus according to claim 11, wherein said control means controls said second heating means to energize it during the initial stage and to deenergize it during the stabilized period.

14. An apparatus according to claim 2, further comprising fan control means for controlling said fan to change a speed of the air between an initial stage of operation of said image forming apparatus and a stabilized state of operation thereof.

15. An apparatus according to claim 2, wherein said fan control means controls said fan to deliver a larger amount of the air during an initial stage of operation of said image forming apparatus than in a stabilized period of operation thereof.

16. An apparatus according to claim 14, wherein said fan control means controls rotational speed of said fan so that the rotational speed is higher in the initial stage than in the stabilized period.

17. An apparatus according to claim 1, wherein said control means operates said second heating means during an initial stage of operation of said image forming apparatus for a predetermined period of time.

18. An apparatus according to claim 1, further comprising heat fixing means for fixing an image with heat, wherein said heat fixing means functions also as said second heating means.

19. An image forming apparatus, comprising:
an image bearing member;
first heating means for heating said image bearing member;
temperature detecting means for detecting temperature of said image bearing member;
first control means for controlling said first heating means in accordance with an output of said temperature detecting means;
second heating means for heating air;
means for guiding the air heated by said second heating means to said image bearing member; and
second control means for controlling said second heating means in accordance with the output of said temperature detecting means.

20. An apparatus according to claim 19, wherein said second control means controls said second heating means to energize during an initial stage of operation of said image forming apparatus.

21. An apparatus according to claim 20, wherein said first control means controls said first heating means to maintain a substantially constant temperature of said image bearing member, and wherein said second control means controls to deenergize said second heating means when the temperature of said image bearing member reaches a predetermined level, the predetermined level of the temperature is substantially equal to the constant temperature.

22. An apparatus according to claim 19, wherein said first control means controls said first heating means to maintain a substantially constant temperature of said image bearing member, and wherein said second heating means controls said second heating means so that temperature of the air introduced to said image bearing member is substantially equal to the constant temperature.

23. An apparatus according to claim 20, wherein said first control means controls said first heating means to maintain a substantially constant temperature of said image bearing member, and wherein temperature of the air introduced to said image bearing member during at least a part of an initial stage of operation of said image forming apparatus is higher than the constant temperature.

24. An image forming apparatus, comprising:
an image bearing member;

means for heating air;

means for guiding the heated air to said image bearing member; and control means for energizing said heating means during an initial stage of operation of said image forming apparatus.

25. An apparatus according to claim 24, wherein said guiding means includes a fan.

26. An apparatus according to claim 24, wherein said image bearing member has a surface layer of amorphous silicon.

27. An apparatus according to claim 24, further comprising means for generating ions to be applied to said image bearing member, said ion generating means having ion generating portion which is disposed in a path of flow of the air to said image bearing member.

28. An apparatus according to claim 27, wherein the ion generating portion is disposed upstream of said image bearing member with respect to a direction of the flow of the air, wherein the air reaches said image bearing member after passing around the ion generating portion.

29. An apparatus according to claim 24, wherein said control means energizes said heating means during a waiting period of said apparatus.

30. An apparatus according to claim 24, further comprising optical system for projecting a light image of an original onto said image bearing member, wherein the air adjacent said optical system is introduced to said image bearing member through a filter and said heating means.

31. An apparatus according to claim 24, heat insulating material is disposed between said optical system and a guide for guiding the air to said image bearing member.

* * * * *

UNITED STATES PATENT AND TRADEMARK OFFICE

CERTIFICATE OF CORRECTION

PATENT NO. : 4,720,727

DATED : January 19, 1988

INVENTOR(S) : YASUMI YOSHIDA

It is certified that error appears in the above-identified patent and that said Letters Patent is hereby corrected as shown below:

COLUMN 1

Line 29, "rendered" should be deleted.

Line 38, "candensation" should read --condensation--.

Line 43, "a" should be deleted.

COLUMN 2

Line 1, "invention wherein" should read --invention to provide an image forming apparatus wherein--.

Line 65, "illuminate to" should read --to illuminate--.

COLUMN 3

Line 20, "an" should read --a--.

Line 21, "remained" should read --remaining--.

Line 25, "above described" should read --above-described--.

Line 56, "an arrows" should read --the arrows--.

COLUMN 4

Line 36, "Since, the" should read --Since the--.

Line 43, "uniform is" should read --uniform, is--.

Line 54, "openings" should read --opening--.

UNITED STATES PATENT AND TRADEMARK OFFICE

CERTIFICATE OF CORRECTION

PATENT NO. : 4,720,727

DATED : January 19, 1988

INVENTOR(S) : YASUMI YOSHIDA

It is certified that error appears in the above-identified patent and that said Letters Patent is hereby corrected as shown below:

COLUMN 5

Line 17, "fan 32." should read --fan 25.--.
Line 51, "to" should be deleted.
Line 52, "is increased" should be deleted.
Line 56, "asisting" should read --assisting--.

COLUMN 6

Line 8, "rest" should read --inactive--.

COLUMN 7

Line 21, "propert" should read --property--.
Line 64, "switch Thus," should read --switch. Thus,--.

COLUMN 8

Line 67, "above described" should read --above-described--.

COLUMN 9

Line 63, "number" should read --the number--.

COLUMN 10

Line 1, "comm-" should read --com- --.
Line 54, "heat-" should read --control--.
Line 55, "ing" should be deleted.

UNITED STATES PATENT AND TRADEMARK OFFICE

CERTIFICATE OF CORRECTION

PATENT NO. : 4,720,727

DATED : January 19, 1988

INVENTOR(S) : YASUMI YOSHIDA

It is certified that error appears in the above-identified patent and that said Letters Patent is hereby corrected as shown below:

COLUMN 12

Line 14, "claim 24, heat" should read --claim 24, wherein heat--.

Signed and Sealed this

Twenty-fifth Day of October, 1988

*Attest:*

DONALD J. QUIGG

*Attesting Officer*

*Commissioner of Patents and Trademarks*